US008402617B2

(12) United States Patent
Wang

(10) Patent No.: US 8,402,617 B2
(45) Date of Patent: Mar. 26, 2013

(54) SAND-REMOVING SEAT BELT BUCKLE

(76) Inventor: Liang-Hsiung Wang, Tainan (TW)

( * ) Notice: Subject to any disclaimer, the term of this patent is extended or adjusted under 35 U.S.C. 154(b) by 107 days.

(21) Appl. No.: 13/049,118

(22) Filed: Mar. 16, 2011

(65) Prior Publication Data

US 2012/0233822 A1 Sep. 20, 2012

(51) Int. Cl.
*A44B 11/25* (2006.01)

(52) U.S. Cl. ..... 24/633; 24/629

(58) Field of Classification Search ..... 24/614, 24/615, 629, 633, 697.1
See application file for complete search history.

(56) References Cited

U.S. PATENT DOCUMENTS 5,926,928 A * 7/1999 Lundstedt ..... 24/625
6,205,628 B1 * 3/2001 Downie ..... 24/633
6,637,083 B1 * 10/2003 Howell ..... 24/614
6,763,557 B2 * 7/2004 Steiff et al. ..... 24/639
7,614,124 B2 * 11/2009 Keene et al. ..... 24/638
2008/0040905 A1 * 2/2008 Webber et al. ..... 24/633
2008/0086853 A1 * 4/2008 Kolasa ..... 24/625
2008/0172847 A1 * 7/2008 Keene et al. ..... 24/633
2009/0083955 A1 * 4/2009 Smith ..... 24/633

* cited by examiner

*Primary Examiner* — Robert J Sandy
*Assistant Examiner* — Rowland D Do
(74) *Attorney, Agent, or Firm* — Bacon & Thomas, PLLC

(57) ABSTRACT

A sand-removing seat belt buckle has a housing and a latching assembly. The housing has a chamber, a first opening and a second opening formed through two ends of the housing, at least one sand cavity formed through a bottom of the housing and being adjacent to the second opening, and at least one support bump formed on an inner bottom of the housing. The latching assembly serves to latch and unlatch an insertion member, and is securely mounted in the housing and on top of the at least one support bump, so that a space is formed between the insertion member and the inner bottom of the housing and communicates with the first opening, the second opening and the sand cavity. Sand, mud and crushed pebbles entering from the first opening can be removed from the sand cavity and the second opening through the space without being deposited inside the seat belt buckle.

4 Claims, 8 Drawing Sheets

SAND-REMOVING SEAT BELT BUCKLE

BACKGROUND OF THE INVENTION

1. Field of the Invention

The present invention relates to a seat belt buckle, and more particularly to a seat belt buckle having a sand-removing capability.

2. Description of the Related Art

Seat belt buckles are commonly used together with belts to protect drivers and passengers seated on a transportation tool, such as a vehicle or an airplane, against sudden impact arising from a collision or accident.

A seat belt buckle usually has spring members therein so that the elastic capability of the spring members allows a tongue of the seat belt buckle to be inserted into and ejected from a buckle of the seat belt buckle. Such seat belt buckles have a poor performance in removing sand, mud and crushed pebbles, especially when vehicles equipped with such seat belt buckles have a beach driving, desert driving or mud driving.

Sands and crushed pebbles stuck in a seat belt buckle occupy the space inside the seat belt buckle and inevitably affect the spring members to normally extend or retract. As a consequence, these foreign matters cause abnormal operation of the seat belt buckle, damage of the seat belt buckle and operational inconvenience, and may even jeopardize personal safety.

SUMMARY OF THE INVENTION

An objective of the present invention is to provide a sand-removing seat belt buckle.

To achieve the foregoing objective, the sand-removing seat belt buckle has an insertion member and a housing. The housing is hollow and has a first opening and a second opening, at least one sand cavity and at least one support bump.

The first opening and the second opening are respectively formed through two ends of the housing.

The at least one sand cavity is formed through a bottom of the housing and is adjacent to the second opening.

The at least one support bump is formed on an inner bottom surface of the housing.

The latching assembly serves to latch and unlatch the insertion member, and is securely mounted in the housing and on tops of the support bumps, and defines a space between the latching assembly and the inner bottom surface of the housing to communicate with the first opening, the second opening and the at least one sand cavity.

Given that the space formed between the latching assembly and the inner bottom surface of the housing communicates with the first opening, the second opening and the sand cavity, sand, mud or crushed pebbles entering the sand-removing seat belt buckle can be drained from the sand cavity and the second opening through the space.

Other objectives, advantages and novel features of the invention will become more apparent from the following detailed description when taken in conjunction with the accompanying drawings.

DETAILED DESCRIPTION OF THE INVENTION

Figure 1:
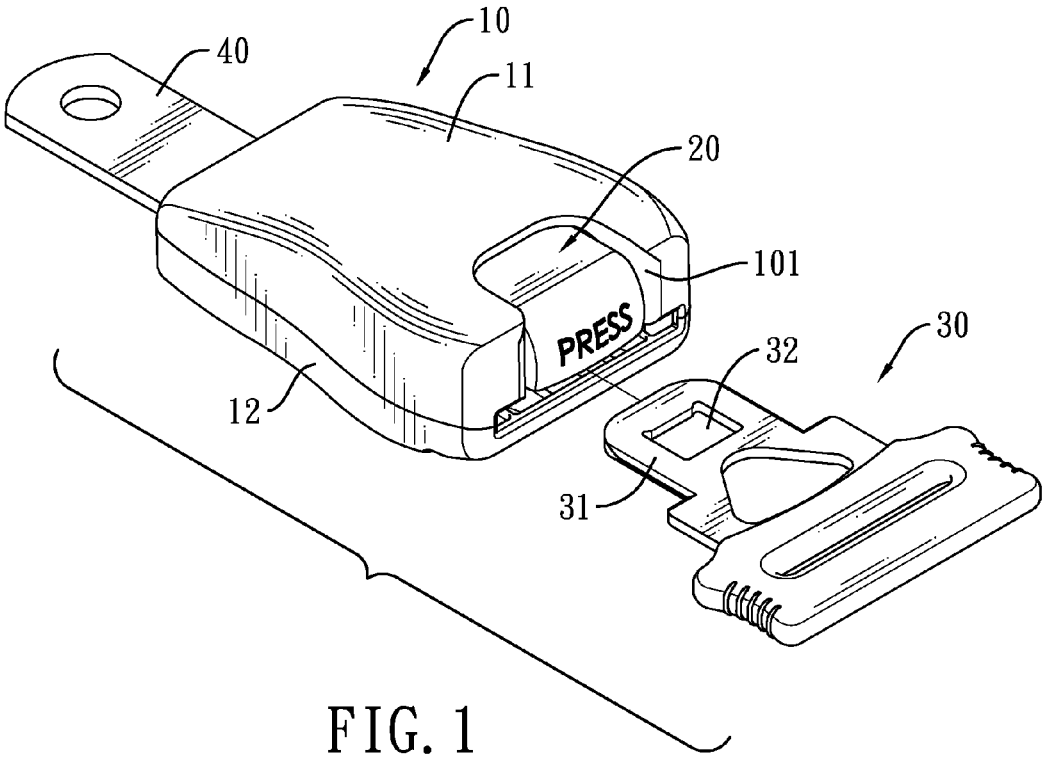
FIG. 1 is an exploded perspective view of a sand-removing seat belt buckle in accordance with the present invention.
Figure 2:
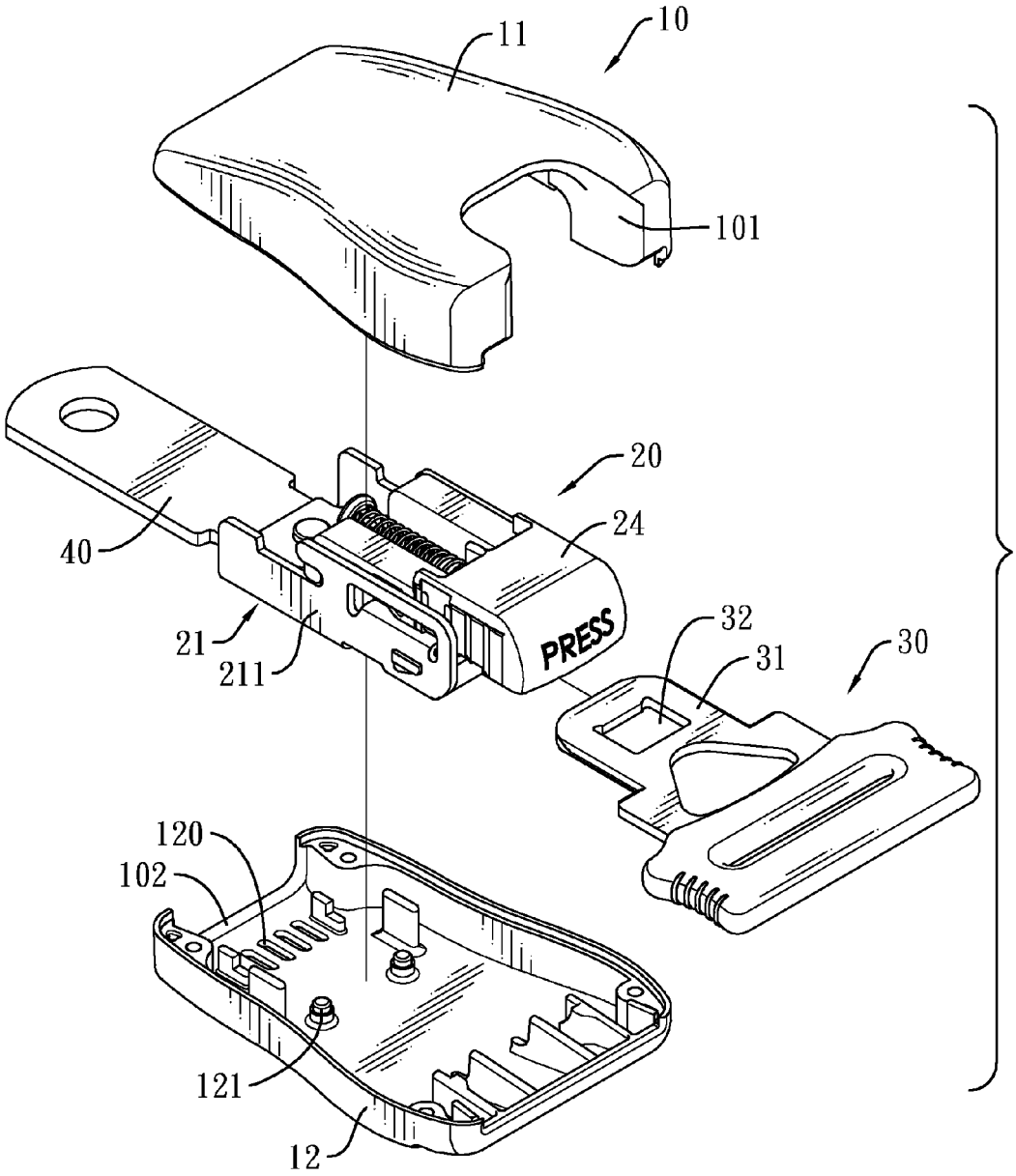
FIG. 2 is a partially exploded perspective view of the sand-removing seat belt buckle in FIG. 1.
Figure 3:
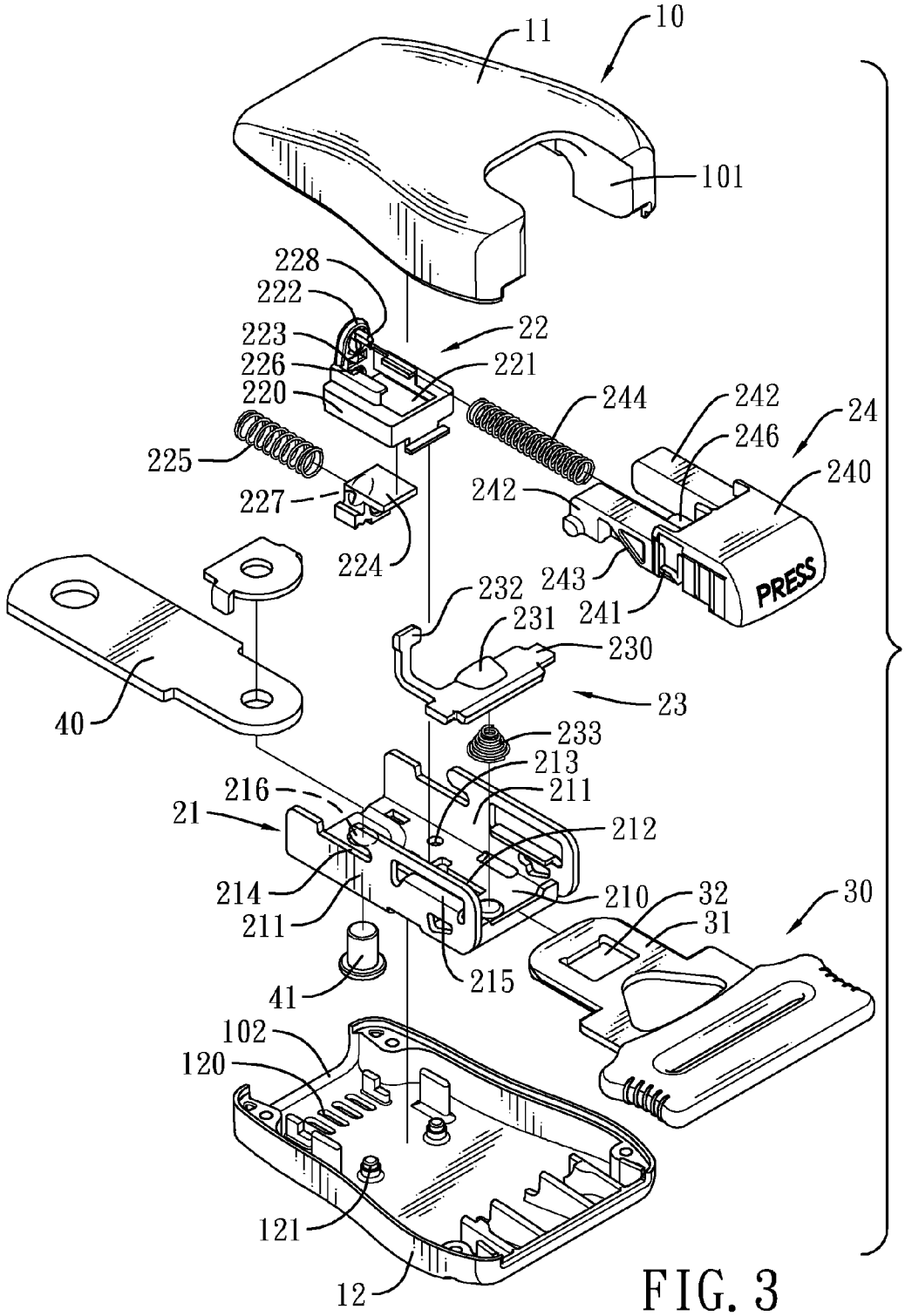
FIG. 3 is an exploded perspective view of the sand-removing seat belt buckle in FIG. 1.
Figure 4:
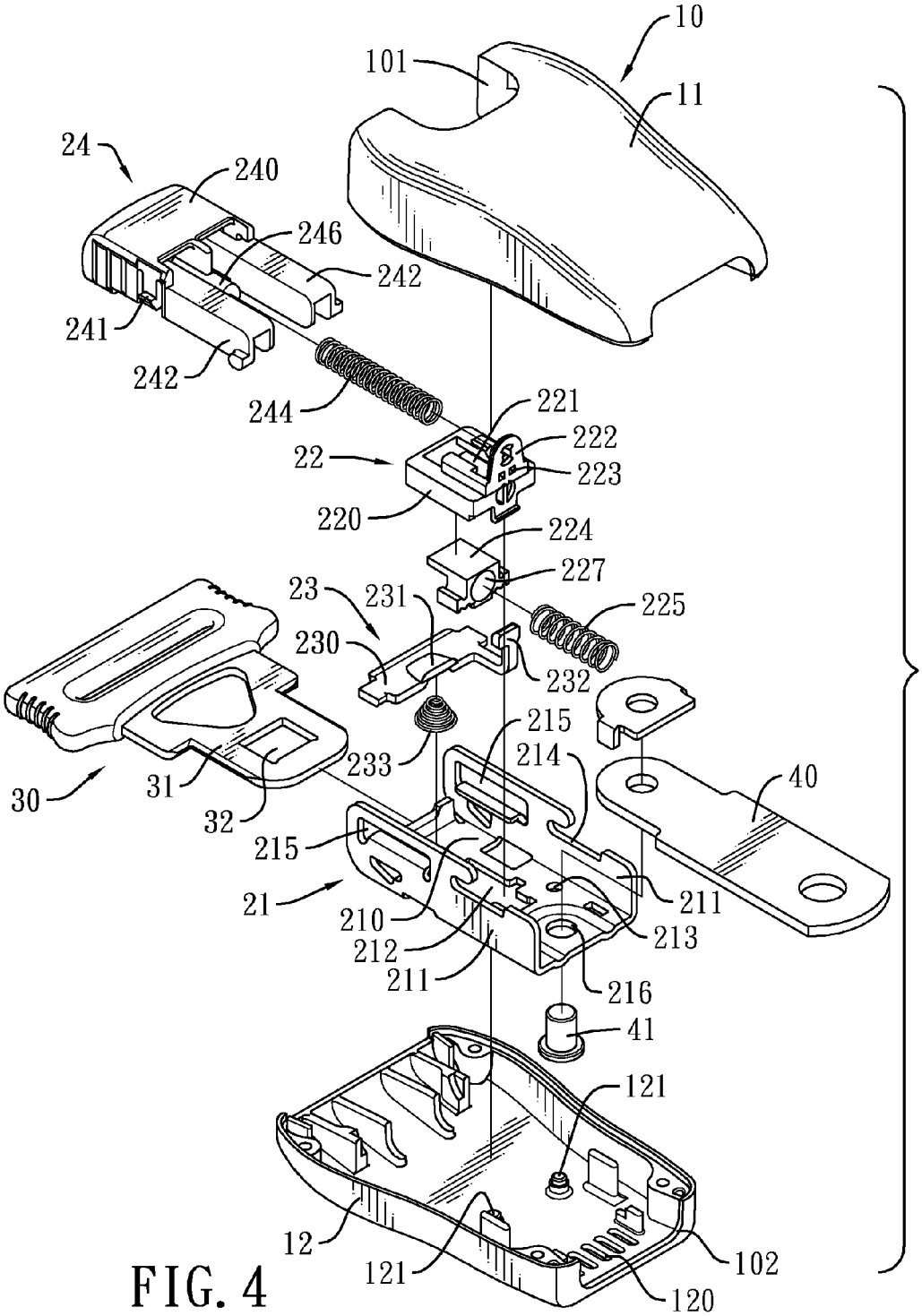
FIG. 4 is another exploded perspective view of the sand-removing seat belt buckle in FIG. 1.

With reference to FIGS. 1 to 4, a sand-removing seat belt buckle in accordance with the present invention has an insertion member 30 and a buckle.

The insertion member 30 has a tongue 31 and a latching hole 32. The tongue 31 is formed on and protrudes from one end of the insertion member 30. The latching hole 32 is formed through the tongue 31.

The buckle has a housing 10, a connection element 40 and a latching assembly 20. The housing 10 is composed of a bottom cover 12 and a top cover 11 correspondingly mounted on the bottom cover 12, and has a chamber, a first opening 101, a second opening 102, at least one sand cavity 120 and at least one support bump 121. The first opening 101 and the second opening 102 are respectively formed through two ends of the housing 10. The at least one sand cavity 120 is formed through a bottom of the housing 10, and is adjacent to the second opening 102. The at least one support bump 121 is formed on an inner bottom surface of the housing 10.

The connection element 40 is securely connected to a vehicle, and may be a plate or a cable.

Figure 5:
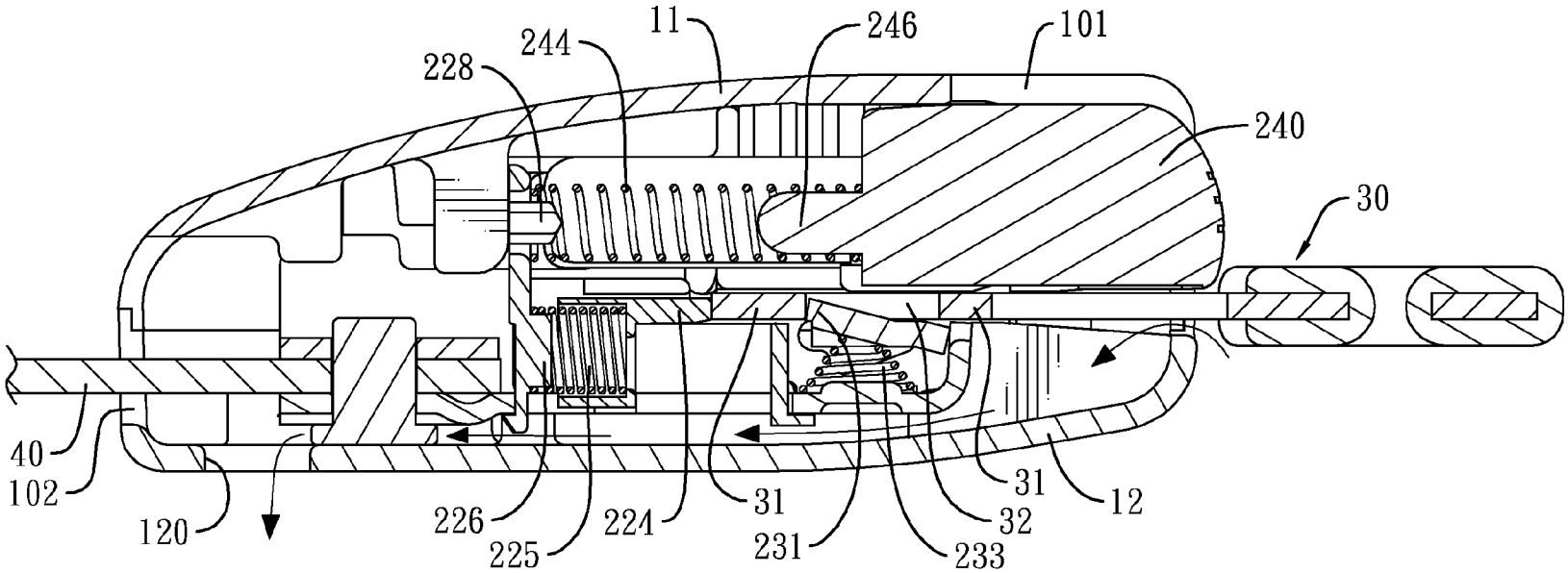
FIG. 5 is a cross-sectional side view of a tongue and a buckle of the sand-removing seat belt buckle in FIG. 1 latching each other.
Figure 8:
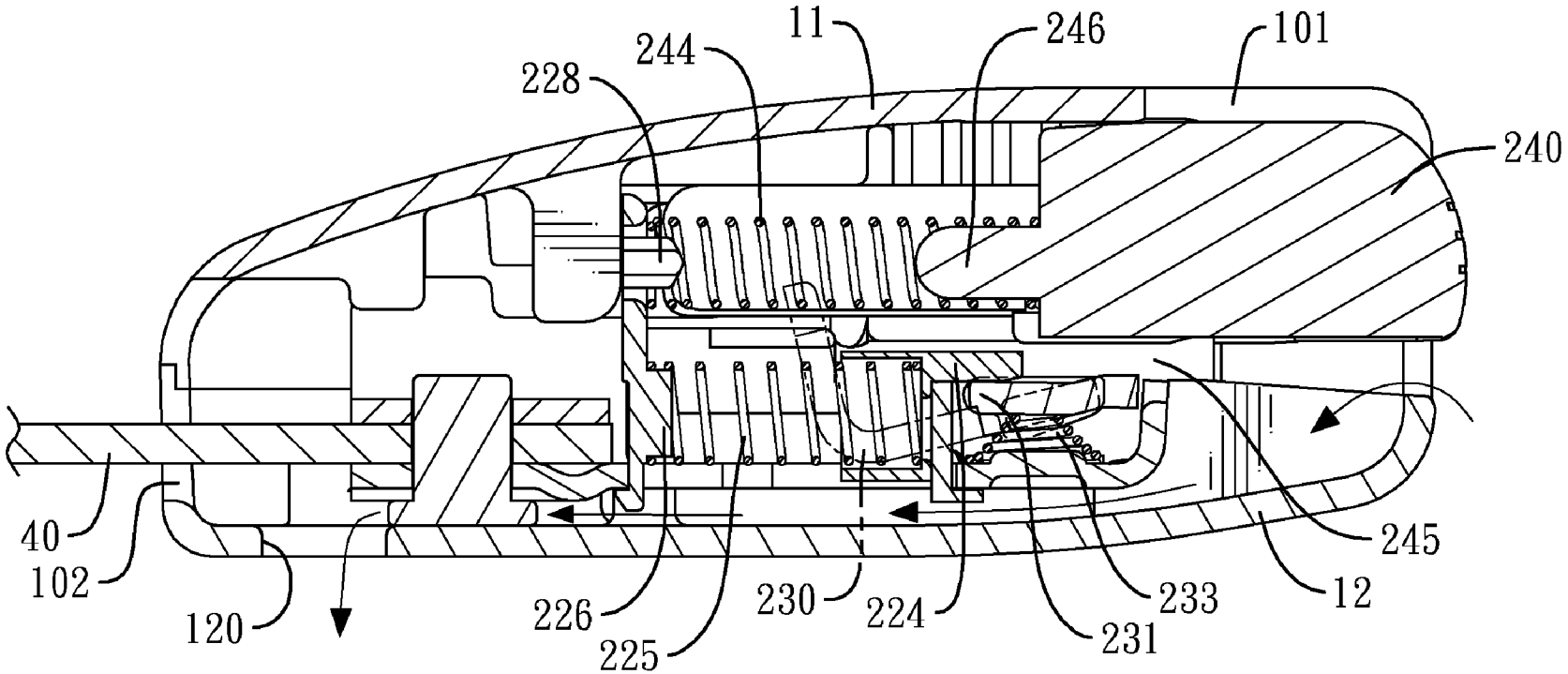
FIG. 8 is a further operational cross-sectional side view of the buckle of the sand-removing seat belt buckle in FIG. 1, shown when the tongue is completely ejected from the buckle.

The latching assembly 20 is securely mounted in the housing 10 and on tops a top of each of the at least one support bumps bump 121, and defines a space between the latching assembly 20 and the inner bottom surface of the housing 10. With further reference to FIGS. 5 and 8, the space communicates with the first opening 101, the second opening 102 and the at least one sand cavity 120. The latching assembly 20 has a frame 21, a fixing seat 22, a latching member 23 and a press button 24. The frame 21 has a bottom board 210, two walls 211 and a through hole 216. The bottom board 210 has a sand-removing hole 212 and at least one positioning hole 213. The sand-removing hole 212 is formed through the bottom board 210. The at least one positioning hole 213 is formed through the bottom board 210 and respectively corresponds to and aligns with the at least one support bump 121 of the housing 10 so that the frame 21 can be mounted on the top of the at least one support bump 121 through the at least one positioning hole 213 to form the space between the frame 21 and the inner bottom surface of the housing 10. The walls 211 are respectively formed on and protrude from two sides of the bottom board 210, and each wall 211 has a notched track 214 and a guide slot 215. The notched track 214 is formed in a top edge of the wall 211. The guide slot 215 is formed through the wall 211. The through hole 216 is formed through the bottom board 210 and is adjacent to the second opening 102. The bottom board 210 is securely fastened on the connection element 40 by a fastener 41 mounted through the through hole 216.

The fixing seat 22 has a base 220, an ejector 224 and a first spring 225. The base 220 is mounted on the frame 21, and has a mounting cavity 221, an abutting portion 222 and a protruding block 226. The mounting cavity 221 is longitudinally formed through the base 220. The abutting portion 222 is formed on and protrudes upwardly from one end of the base 220 adjacent to the second opening 102, and has at least one sand hole 223 formed through the abutting portion 222. The protruding block 226 is formed on a first inner wall of the mounting cavity 221 on the same side of the at least one sand hole 223 and protrudes toward the first opening 101. The ejector 224 is movably mounted in the mounting cavity 221 of the base 220, and has a recessed hole 227 formed in one end of the ejector 224 facing the second opening 102. The first spring 225 is mounted in the mounting cavity 221. One end of the first spring 225 abuts against the protruding block 226 of the base 220, and the other end of the first spring 225 abuts against the inner surface of the recessed hole 227 of the ejector 224, so that the ejector 224 is pushed by the first spring 225 to abut against a second inner wall of the mounting cavity 221 opposite to the first inner wall. When an external force is exerted on the ejector 224 to move the ejector 224 toward the second opening 102, the first spring 225 is compressed. When the external force no longer exists, the restoring elastic force of the first spring 225 restores the ejector 224 back to its original position.

The latching member 23 is mounted on one side of the fixing seat 22 facing the first opening 101, and has a bottom seat 230, a latching block 231, an ejector arm 232 and a second spring 233. Two opposite ends of the bottom seat 230 are respectively and swingingly mounted through the walls 211 and are adjacent to the fixing seat 22. The latching block 231 is formed on one edge of the bottom seat 230 facing the second opening 102, and has a descending slope from one end of the latching block 231 adjacent to the second opening 102 to the other end adjacent to the first opening 101. The ejector arm 232 is L-shaped, and is formed on and protrudes upwardly from the edge of the bottom seat 230 facing the second opening 102. The second spring 233 is mounted between a bottom of the bottom seat 230 and the frame 21, is compressed when an external force is exerted on the bottom board 230, and restores and lifts the latching member 23 to its original position with the elastic force of the second spring 233 when the external force no longer exists.

The press button 24 is mounted through the first opening 101 and on the frame 21. With further reference to FIG. 8, a tongue insertion space 245 is defined between the press button 24 and the bottom seat 230 of the latching member 23 for the tongue 31 of the insertion member 30 to be inserted in. The press button 24 has a button body 240 and a third spring 244. The button body 240 has two sliding bars 242 and two secure portions 241. The sliding bars 242 are parallelly formed on and protrude from one end of the button body 240 facing the second opening 102. One of the sliding bars 242 has a slanted surface 243 formed in an outer sidewall of the sliding bar 242 and having an ascending slope from an end of the slanted surface 243 adjacent to the first opening 101 to the other end adjacent to the second opening 102. Each secure portion 241 is formed on a junction on a periphery of the press button 24 and between the button body 240 and one of the sliding bars 242. Each secure portion 241 and each sliding bar 242 are respectively and slidably mounted in a corresponding guide slot 215 and a corresponding notched track 214. The third spring 244 is mounted between the button body 240 and the abutting portion 222 of the base 220 of the fixing seat 22 so that the press button 24 can be slidably moved toward the first opening 101 or the second opening 102. The button body 240 further has a rod 246 formed between the sliding bars 242 and facing the second opening 102. The abutting portion 222 has a nose 228 formed on the abutting portion 222 and facing the first opening 101. The third spring 244 is mounted around and between the rod 246 and the nose 228. When an external force is exerted on the press button 24 to move the press button 24 toward the second opening 102, the restoring elastic force tends to push the press button 24 toward the first opening 101. When the external force no longer exists, the restoring elastic force restores the press button 24 back to its original position.

With reference to FIG. 5, when the tongue 31 of the insertion member 30 is inserted into the tongue insertion space 245 and between the press button 24 and the latching block 231, the tongue 31 pushes the ejector 224 of the fixing seat 22 to move toward the second opening 102. When the latching hole 32 of the insertion member 30 is moved to a position aligning with the latching block 231, the second spring 233 is expanded to lift the latching block 231 up so that the latching block 231 latches the latching hole 32 and the insertion member 30 is securely locked between the press button 24 and the bottom seat 230 of the latching member 23. At this time, the ejector arm 232 on the latching member 23 is held in a space defined by the slanted surface 243 of the press button 24.

Figure 6:
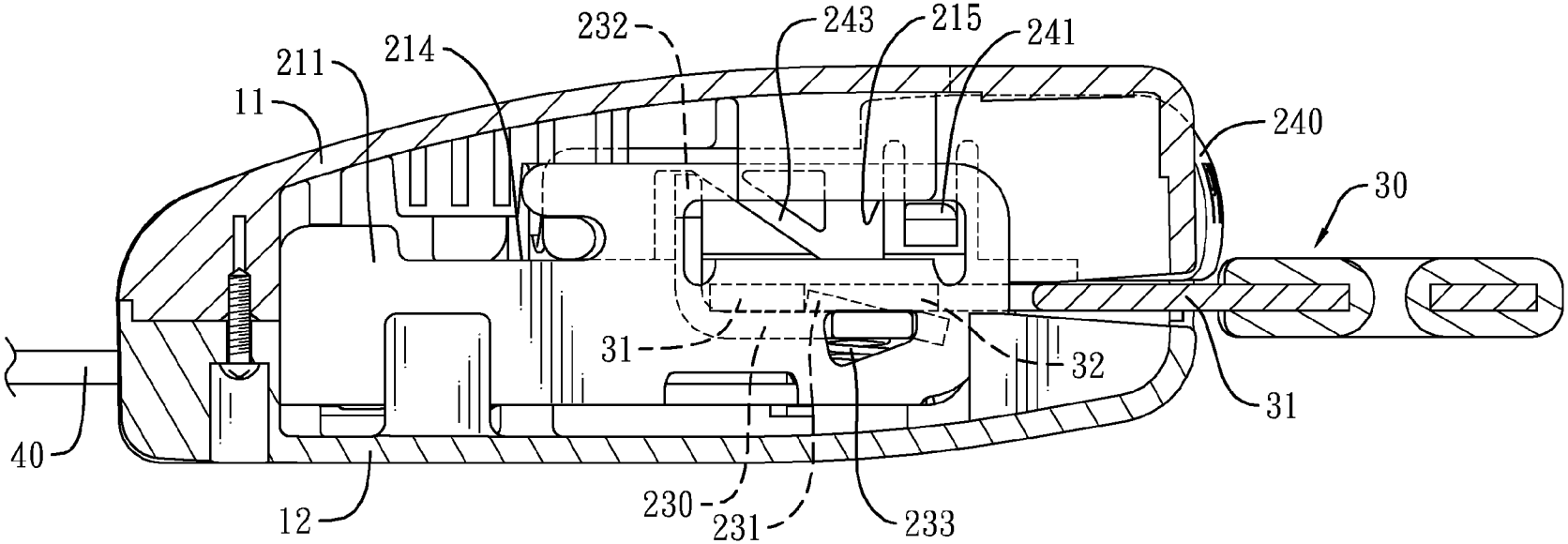
FIG. 6 is an operational side view in partial section of the tongue and the buckle of the sand-removing seat belt buckle in FIG. 1, shown when the tongue is latched by the buckle.
Figure 7:
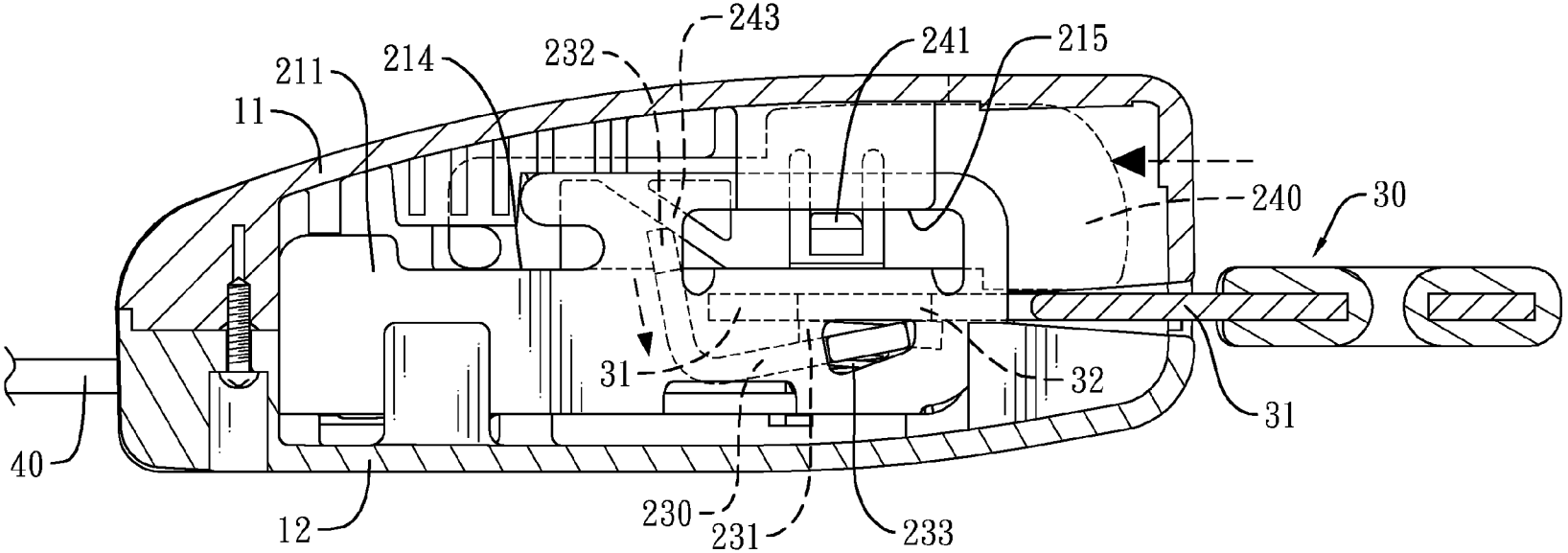
FIG. 7 is another operational side view in partial section of the tongue and the buckle of the sand-removing seat belt buckle in FIG. 1, shown when the tongue is unlatched from the buckle.

With reference to FIGS. 6 to 8, the insertion member 30 is ejected when the press button 24 is pushed further into the housing 10. The slanted surface 243 of the press button 24 then pushes the ejector arm 232 of the latching member 23, so that the bottom seat 230 tilts relative to the insertion member 30, and the latching block 231 on the bottom seat 230 also tilts and is unlatched from the latching hole 32 of the insertion member 30. After the latching block 231 is unlatched from the latching hole 32, the first spring 225 is expanded to push the ejector 224 of the fixing seat 22 to move toward the first opening 101. The ejector 224 further pushes the tongue 31 toward the first opening 101. The tongue 31 is removed from the tongue insertion space 245 between the press button 24 and the bottom seat 230, and the insertion member 30 is separated from the buckle. After the press button 24 is released, the third spring 244 is expanded to push the press button 24 to its original position.

Because of the sand-removing hole 212 on the bottom board 210 of the frame 21 and the space formed between the latching assembly 20 and the bottom cover 12 and communicating with the first opening 101, the second opening 102 and the at least one sand cavity 120 in the bottom cover 12, when sand, mud, crushed pebbles enter the sand-removing seat belt buckle, these foreign matters can be drained through the sand-removing hole 212, the at least one sand cavity 120, the first opening 101 and the second opening 102. Additionally, part of the foreign matters can be evacuated through the at least one sand hole 223 of the abutting portion 222 and the second opening 102. Accordingly, sand, mud and crushed pebbles entering the sand-removing seat belt buckle can be easily removed without being deposited inside the housing 10 to affect the normal operation of the first spring 225, the second spring 233 and the third spring 244 and that of the sand-removing seat belt buckle.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. A sand-removing seat belt buckle, comprising:

an insertion member;

a housing being hollow and having:

a first opening and a second opening respectively formed through two ends of the housing;

at least one sand cavity formed through a bottom of the housing and being adjacent to the second opening;

at least one support bump formed on an inner bottom surface of the housing; and a latching assembly serving to latch and unlatch the insertion member, securely mounted in the housing and on a top of each of the at least one support bump, defining a space between the latching assembly and the inner bottom surface of the housing to communicate with the first opening, the second opening and the at least one sand cavity, and having;

a frame having:

a bottom board having;

a sand-removing hole formed through the bottom board; and at least one positioning hole formed through the bottom board and respectively corresponding to and aligning with the at least one support bump of the housing so that the bottom board is mounted on top of the at least one support bump through the at least one positioning hole;

two walls respectively formed on and protruding from two sides of the bottom board, each wall having:

a notched track formed in a top edge of the wall; and a guide slot formed through the wall;

a fixing seat having:

a base mounted on the frame, and having:

a mounting cavity longitudinally formed through the base; and an abutting portion;

an ejector formed on and protruding upwardly from one end of the base adjacent to the second opening, and movably mounted in the mounting cavity of the base; and a first spring mounted in the mounting cavity, wherein one end of the first spring abuts against one inner wall of the mounting cavity of the base facing the first opening, and the other end of the first spring abuts against the ejector;

a latching member mounted on one side of the fixing seat facing the first opening, and having:

a bottom seat, wherein two opposite ends of the bottom seat are respectively and swingingly mounted through the walls;

a latching block formed on one edge of the bottom seat facing the second opening, and having a descending slope from one end of the latching block adjacent to the second opening to the other end adjacent to the first opening;

an ejector arm formed on and protruding upwardly from the edge of the bottom seat facing the second opening; and a second spring mounted between a bottom of the bottom seat and the frame; and a press button mounted through the first opening and on the frame, forming a tongue insertion space between the press button and the bottom seat of the latching member, and having:

a button body having:

two sliding bars parallelly formed on and protruding from one end of the button body facing the second opening, one of the sliding bars having a slanted surface formed in an outer sidewall of the sliding bar and having an ascending slope from one end of the slanted surface adjacent to the first opening to the other end adjacent to the second opening, and slidably mounted in a corresponding notched track; and two secure portions, each secure portion formed on a junction on a periphery of the press button and between the button body and one of the sliding bars, and slidably mounted in a corresponding guide slot; and a third spring mounted between the button body and the abutting portion of the base of the fixing seat.

2. The sand-removing seat belt buckle as claimed in claim 1, wherein the abutting portion of the fixing seat has at least one sand hole formed through the abutting portion of the fixing seat.

3. The sand-removing seat belt buckle as claimed in claim 1, wherein the housing has a bottom cover and a top cover correspondingly mounted on the bottom cover.

4. The sand-removing seat belt buckle as claimed in claim 2, wherein the housing has a bottom cover and a top cover correspondingly mounted on the bottom cover.

* * * * *